US006488331B2

(12) United States Patent
Chen

(10) Patent No.: US 6,488,331 B2
(45) Date of Patent: Dec. 3, 2002

(54) FOLDABLE CHAIR FRAME

(76) Inventor: Kao-San Chen, No. 282, Sec. 2, Shu-Lin St., Tainan City (TW)

( * ) Notice: Subject to any disclaimer, the term of this patent is extended or adjusted under 35 U.S.C. 154(b) by 41 days.

(21) Appl. No.: 09/750,573

(22) Filed: Dec. 28, 2000

(65) Prior Publication Data

US 2002/0024240 A1 Feb. 28, 2002

(30) Foreign Application Priority Data

Aug. 24, 2000 (TW) ..... 89214573 U

(51) Int. Cl.[7] ..... A47C 4/00
(52) U.S. Cl. ..... 297/42
(58) Field of Search ..... 297/42, 44, 45, 297/452.18

(56) References Cited

U.S. PATENT DOCUMENTS 244,216 A * 7/1881 Fenby
291,062 A * 1/1884 Latour
1,027,692 A * 5/1912 Cole
2,690,792 A * 10/1954 Moss
4,118,065 A * 10/1978 Watkins
4,359,244 A * 11/1982 Koehm
5,718,473 A * 2/1998 Lynch, Jr.
5,984,406 A * 11/1999 Lee

* cited by examiner

*Primary Examiner*—Milton Nelson, Jr.
(74) *Attorney, Agent, or Firm*—Laurence A. Greenberg; Werner H. Stemer; Ralph E. Locher

(57) ABSTRACT

A foldable chair frame includes cross-shaped front and rear leg units, and first and second side frame units. Each of the side frame units includes first, second and third side leg members, and a coupling member. The first side leg member has two ends respectively connected to a lower front leg part of one of the front leg units and an upper rear leg part of one of the rear leg units, and an intermediate leg portion pivotally connected to the coupling member. The second side leg member has two ends respectively connected to an upper front leg part of one of the front leg units and a front end section of the coupling member. The third side leg member has two ends respectively connected to a lower rear leg part of one of the rear leg units and a rear end section of the coupling member. One of the second and third side leg members is connected pivotally to the coupling member to permit movement of the second and third side leg members away from the first side leg member to an unfolded position. The coupling member is provided with first and second limit units to arrest movement of the second and third side leg members relative to the first side leg member when the chair frame is folded.

8 Claims, 11 Drawing Sheets

FOLDABLE CHAIR FRAME

BACKGROUND OF THE INVENTION

1. Field of the Invention

The invention relates to a chair frame, more particularly to a foldable chair frame of an ergonomic design which can be folded or unfolded both transversely and longitudinally to result in a very compact structure.

2. Description of the Related Art

Referring to FIG. 1, a side leg frame of a conventional foldable chair frame is shown to comprise a first side leg 90 with a front end 95, and a second side leg 91 with a rear end 96. Each of the side legs 90, 91 is provided with a pivot pin hole 93 in an intermediate portion thereof. A pivot pin 94 passes through the pivot pin holes 93 for joining the side legs 90, 91 pivotally to each other such that the latter are foldable and extendable relative to each other. As the front and rear ends 95, 96 are at substantially the same level, the conventional chair frame is not ergonomic. For a chair to be ergonomic, the front end of the chair should be at a position lower than that of the rear end of the chair. In the conventional chair frame, if the level of the front end 95 is lowered, due to the pivotal connection between the side legs 90, 91, the angles between the upper portions and between the lower portions of the side legs 90, 91 are unduly large, which may result in increased loading on the chair frame and damage to the chair frame.

In addition, the conventional foldable chair frame can only be folded lengthwise or sidewise in a single direction and, as such, still occupies a relatively large amount of space.

SUMMARY OF THE INVENTION

Therefore, the main object of the present invention is to provide a foldable chair frame of an ergonomic design which can be folded or unfolded both transversely and longitudinally to result in a very compact structure.

Accordingly, a foldable chair frame of this invention includes cross-shaped front and rear leg units, and first and second side frame units. The front leg unit includes a pair of front leg members, each of which has an upper front leg part, a lower front leg part, and an intermediate front leg part between the upper and lower front leg parts. The intermediate front leg parts of the front leg members are connected pivotally to each other. The rear leg unit includes a pair of rear leg members, each of which has an upper rear leg part, a lower rear leg part, and an intermediate rear leg part between the upper and lower rear leg parts. The intermediate rear leg parts of the rear leg members are connected pivotally to each other. The first side frame unit is connected pivotally to the upper front leg part of one of the front leg members, the lower front leg part of the other one of the front leg members, the upper rear leg part of one of the rear leg members, and the lower rear leg part of the other one of the rear leg members. The second side frame unit is connected pivotally to the upper front leg part of the other one of the front leg members, the lower front leg part of said one of the front leg members, the upper rear leg part of the other one of the rear leg members, and the lower rear leg part of said one of the rear leg members. Each of the first and second side frame units includes first, second and third side leg members, and an elongate coupling member. The first side leg member has an upper first leg portion, a lower first leg portion, and an intermediate leg portion between the upper and lower first leg portions. The second side leg member has an upper second leg portion and a lower second leg portion. The third side leg member has an upper third leg portion and a lower third leg portion. The coupling member has a first end section connected to the lower second leg portion of the second side leg member, a second end section connected to the upper third leg portion of the third side leg member, and an intermediate section between the first and second end sections and connected pivotally to the intermediate leg portion of the first side leg member. One of the second and third side leg members is connected pivotally to the coupling member to permit movement of the second and third side leg members away from the first side leg member to an unfolded position. The coupling member is provided with a first limit unit to arrest movement of the second side leg member relative to the first side leg member in the unfolded position, and a second limit unit to arrest movement of the third side leg member relative to the first side leg member in the unfolded position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
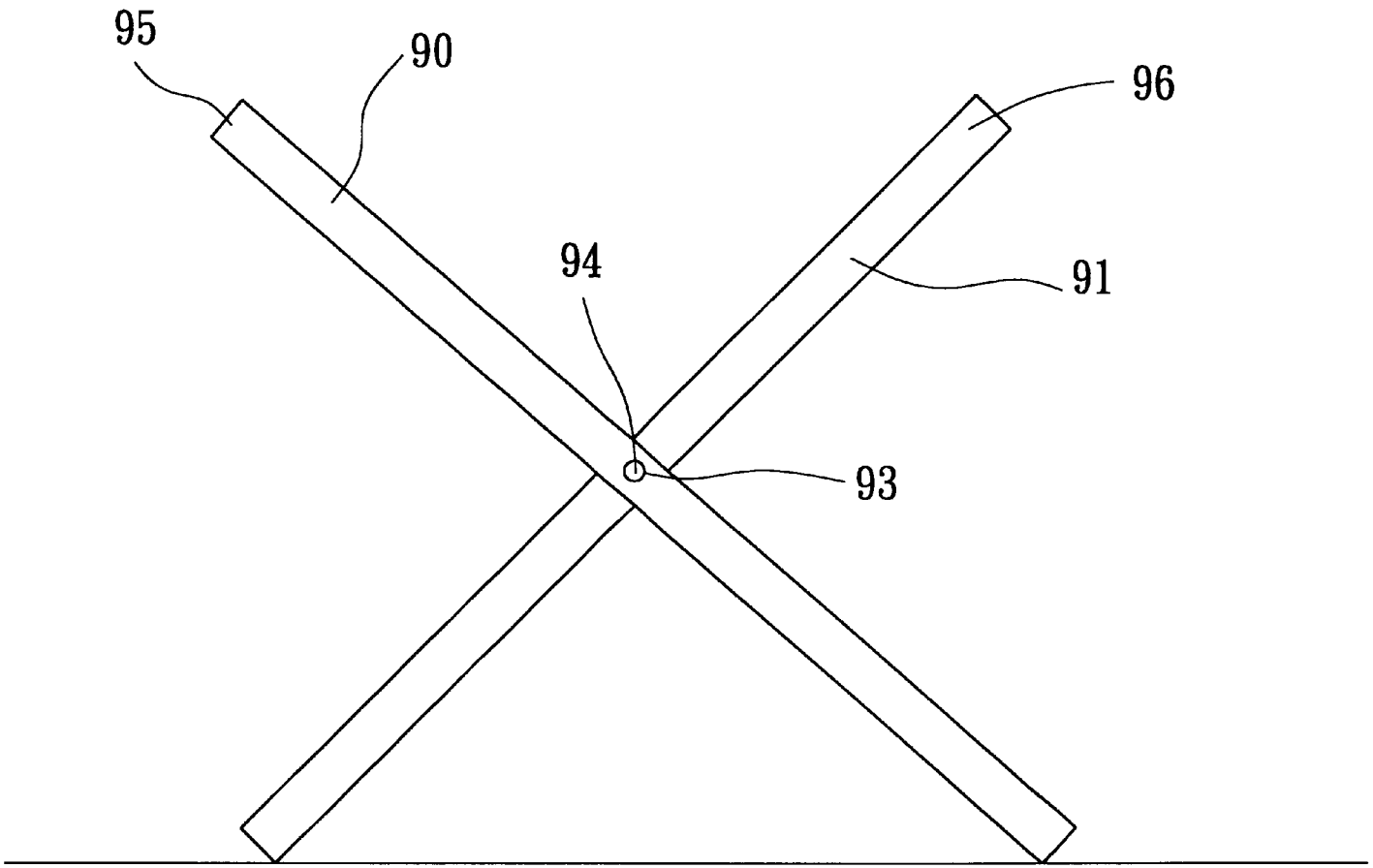
FIG. 1 PRIOR ART
FIG. 1 is a schematic view of a side leg frame of a conventional foldable chair frame.
Figure 2:
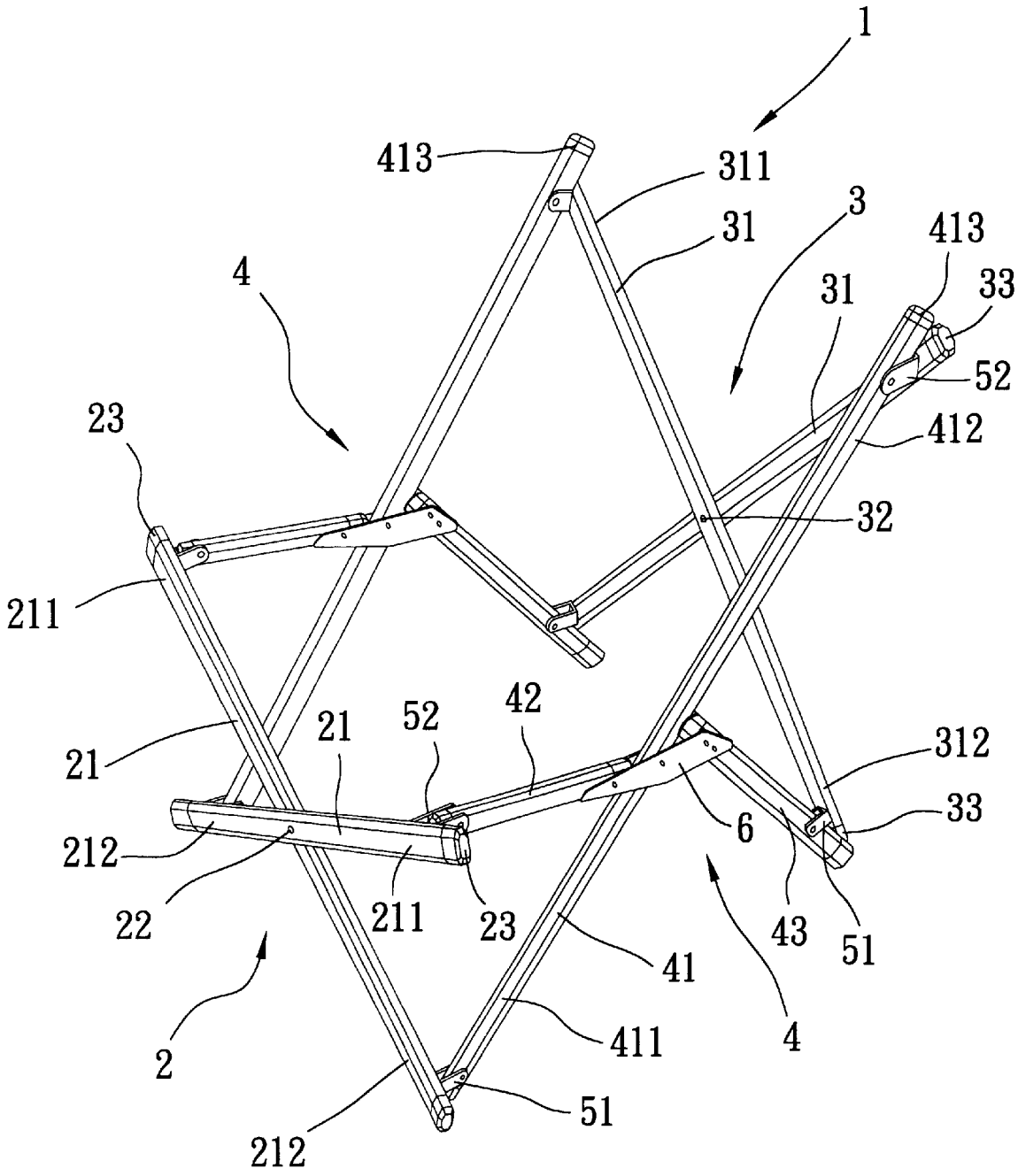
FIG. 2 is a perspective view of the preferred embodiment of a foldable chair frame according to the invention.
Figure 3:
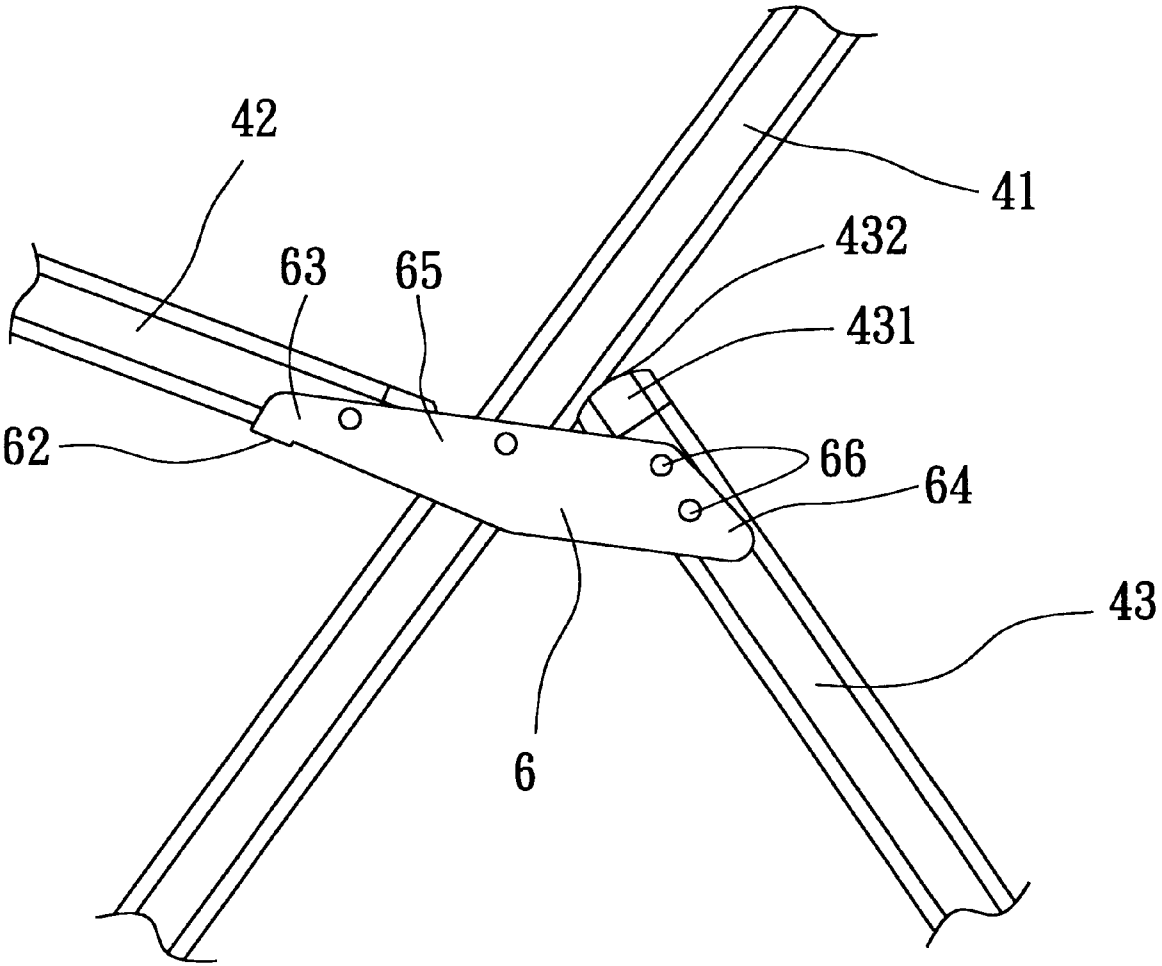
FIG. 3 is a fragmentary schematic view showing a side frame unit according to the preferred embodiment.

Referring to FIGS. 2 and 3, the preferred embodiment of a foldable chair frame 1 according to the present invention is shown to include a cross-shaped front leg unit 2, a cross-shaped rear leg unit 3, and first and second side frame units 4.

The front leg unit 2 includes a pair of front leg members 21, each of which has an upper front leg part 211, a lower front leg part 212, and an intermediate front leg part between the upper and lower front leg parts 211, 212. The intermediate front leg parts of the front leg members 21 are connected pivotally to each other via a pivot pin 22. Each of the upper and lower front leg parts 211, 212 is provided with an end cap 23.

The rear leg unit 3 includes a pair of rear leg members 31, each of which has an upper rear leg part 311, a lower rear leg part 312, and an intermediate rear leg part between the upper and lower rear leg parts 311, 312. The intermediate rear leg parts of the rear leg members 31 are connected pivotally to each other via a pivot pin 32. Each of the upper and lower rear leg parts 311, 312 is provided with an end cap 33.

The first side frame unit 4 is connected pivotally to the upper front leg part 211 of one of the front leg members 21, the lower front leg part 212 of the other one of the front leg members 21, the upper rear leg part 311 of one of the rear leg members 31, and the lower rear leg part 312 of the other one of the rear leg members 31.

The second side frame unit 4 is connected pivotally to the upper front leg part 211 of the other one of the front leg members 21, the lower front leg part 212 of said one of the front leg members 21, the upper rear leg part 311 of the other one of the rear leg members 31, and the lower rear leg part 312 of said one of the rear leg members 31.

Each of the first and second side frame units 4 includes first, second and third side leg members 41, 42, 43, and an elongate coupling member 6. The first side leg member 41 has an upper first leg portion 412, a lower first leg portion 411, and an intermediate leg portion between the upper and lower first leg portions 412, 411. The upper first leg portion 412 is connected pivotally to one of the upper rear leg parts 311 of the rear leg unit 3 via a U-shaped pivot bracket 52. The lower first leg portion 411 is connected pivotally to one of the lower front leg parts 212 of the front leg unit 2 via a U-shaped pivot bracket 51. In addition, each of the upper and lower first leg portions 412, 411 is provided with an end cap 413.

The second side leg member 42 has an upper second leg portion and a lower second leg portion. The upper second leg portion is connected pivotally to one of the upper front leg parts 211 of the front leg unit 2 via a U-shaped pivot bracket 52.

The third side leg member 43 has an upper third leg portion and a lower third leg portion. The lower third leg portion is connected pivotally to one of the lower rear leg parts 312 of the rear leg unit 3 via a U-shaped pivot bracket 51. The upper third leg portion of the third side leg member 43 is provided with an end cap 431. The end cap 431 has a grooved end wall 432 to engage removably the first side leg member 41 when the third side leg member 43 is in the unfolded position.

Figure 4:
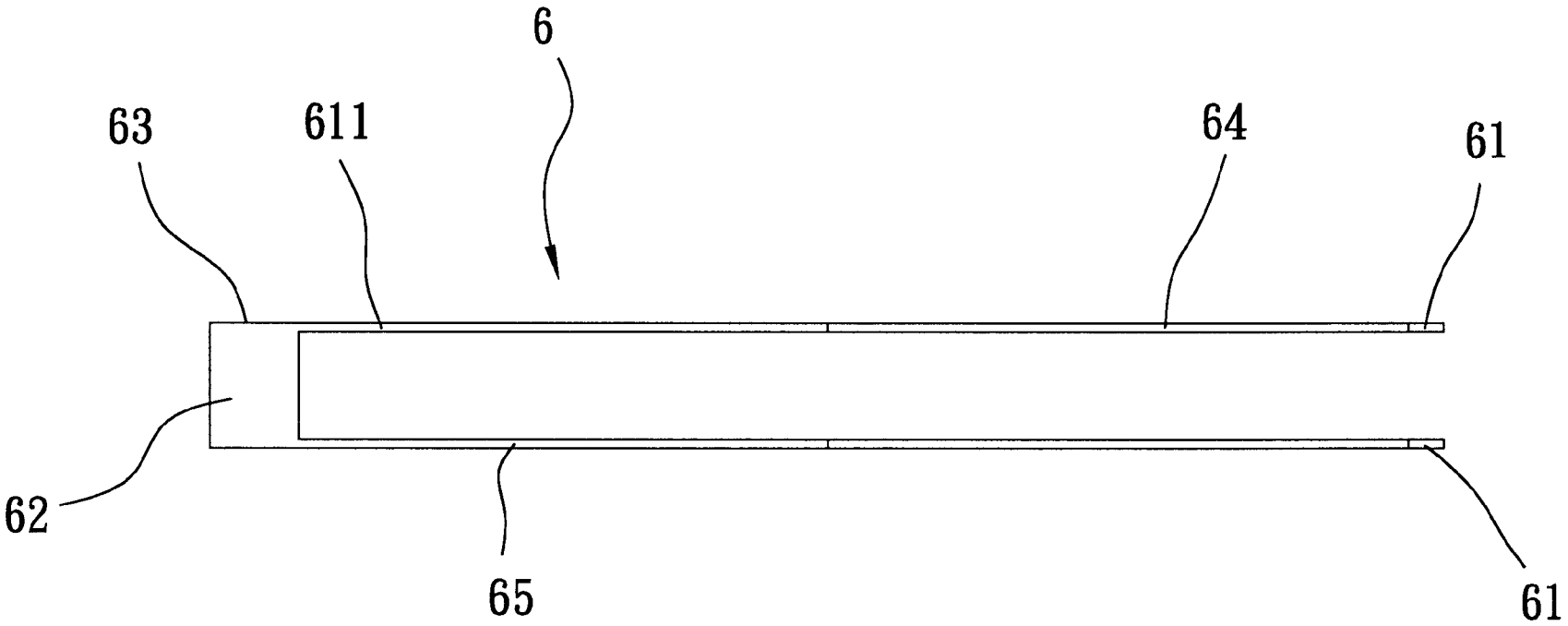
FIG. 4 is a bottom view of a coupling member of the side frame unit shown in FIG. 3.
Figure 9:
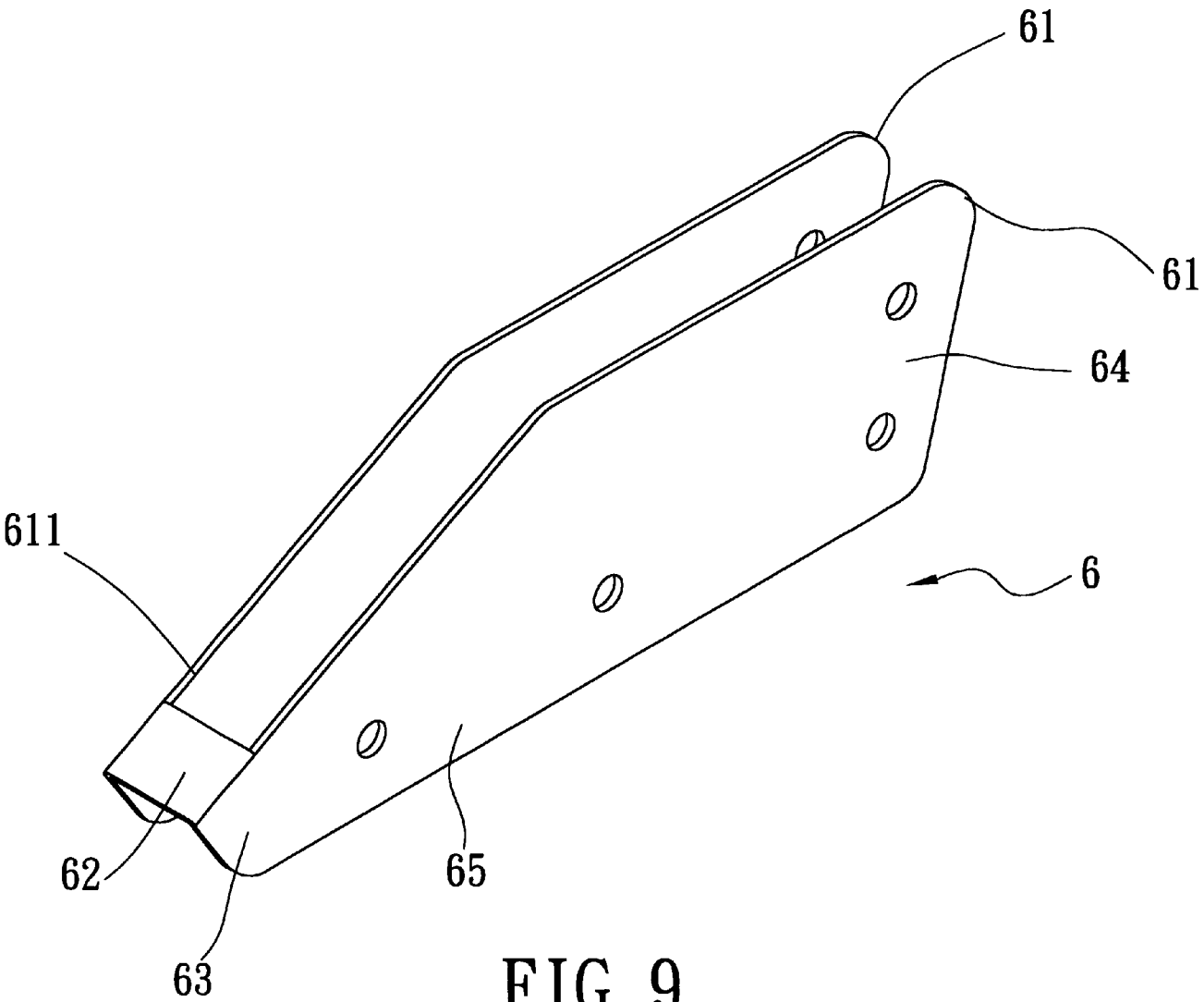
FIG. 9 is a bottom perspective view of the coupling member according to the preferred embodiment.

With further reference to FIGS. 4 and 9, the coupling member 6 has a first end section 65 connected to the lower second leg portion of the second side leg member 42, a second end section 64 connected to the upper third leg portion of the third side leg member 43, and an intermediate section between the first and second end sections 65, 64 and connected pivotally to the intermediate leg portion of the first side leg member 41. One of the second and third side leg members 42, 43 is connected pivotally to the coupling member 6 to permit movement of the second and third side leg members 42, 43 away from the first side leg member 41 to an unfolded position. The coupling member 6 includes a parallel pair of side plates 61 having the first side leg member 41 extending therebetween. Furthermore, the coupling member 6 is provided with a first limit unit to arrest movement of the second side leg member 42 relative to the first side leg member 41 in the unfolded position, and a second limit unit to arrest movement of the third side leg member 43 relative to the first side leg member 41 in the unfolded position. The first limit unit includes a bridging plate 62 interconnecting lower edges 611 of the side plates 61 at the first end section 65 and abutting against the second side leg member 42 to limit movement of the second side leg member 42 relative to the coupling member 6 when the second side leg member 42 is in the unfolded position, as shown in FIG. 3. The second limit unit includes a pair of mounting pins 66 for fixing the third side leg member 43 to the second end section 64 of the coupling member 6.

Figure 5:
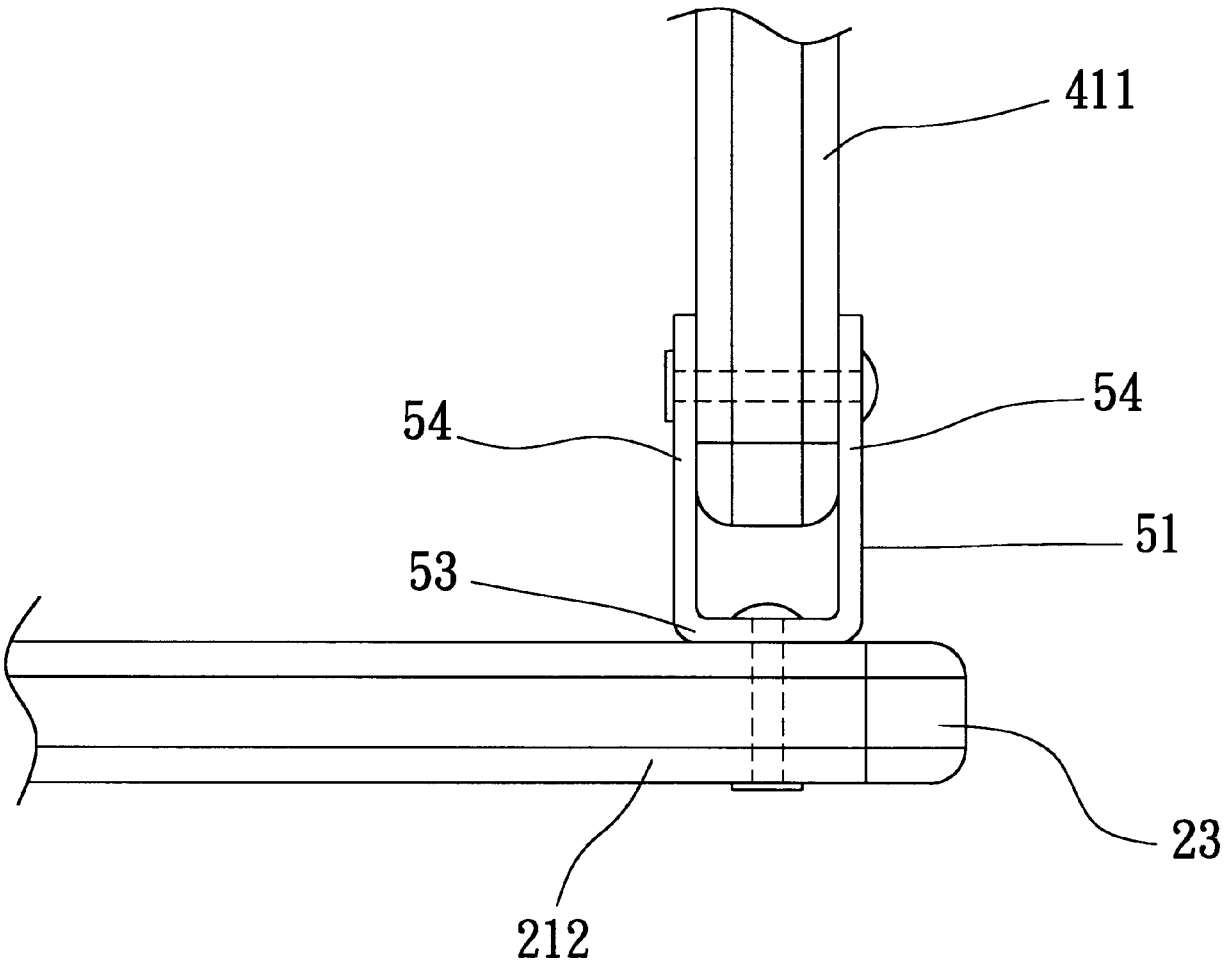
FIG. 5 is a fragmentary schematic plan view illustrating a U-shaped pivot bracket which interconnects a lower front leg part and a first side leg member according to the preferred embodiment.
Figure 7:
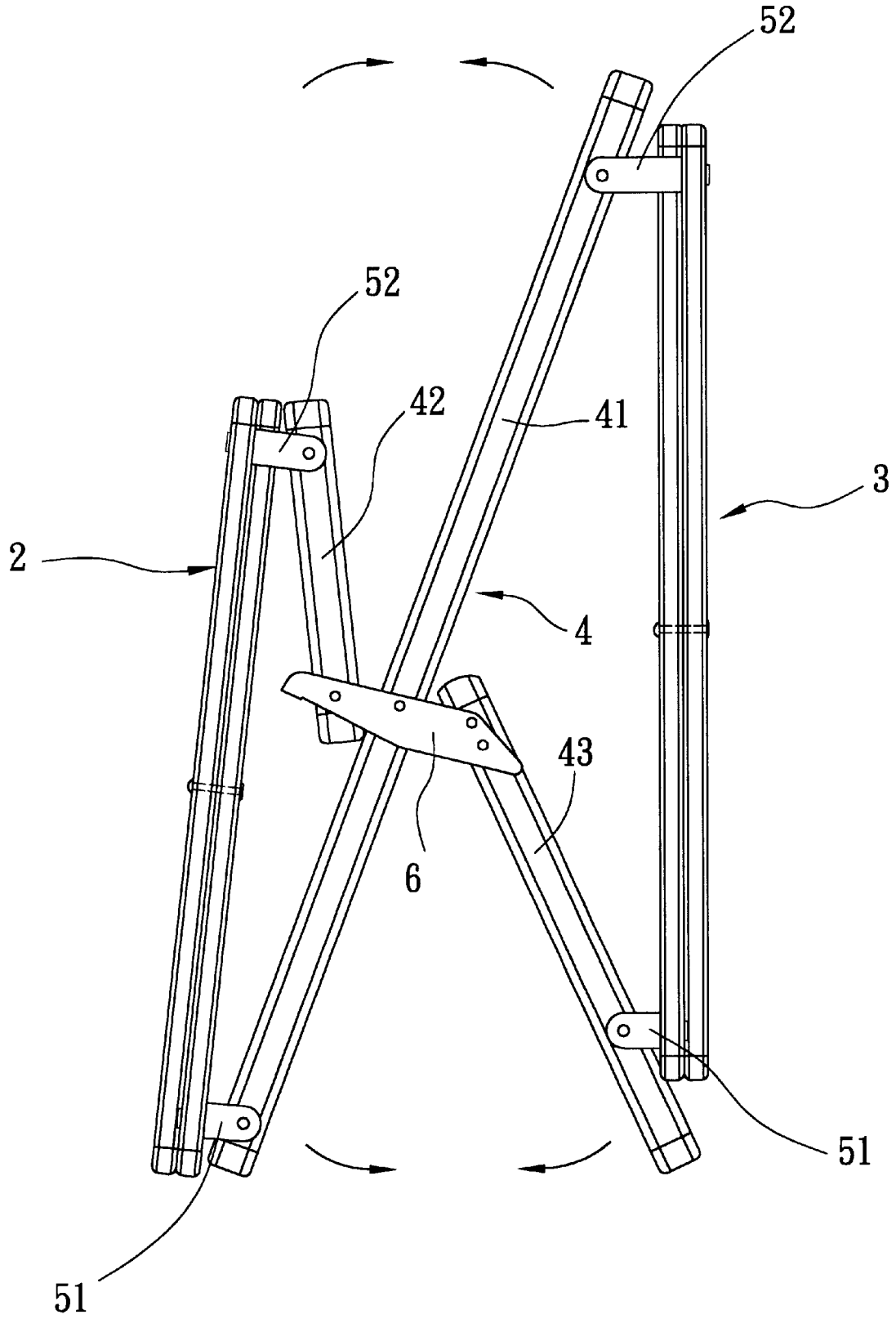
FIG. 7 is a side view illustrating folding of the preferred embodiment.
Figure 10:
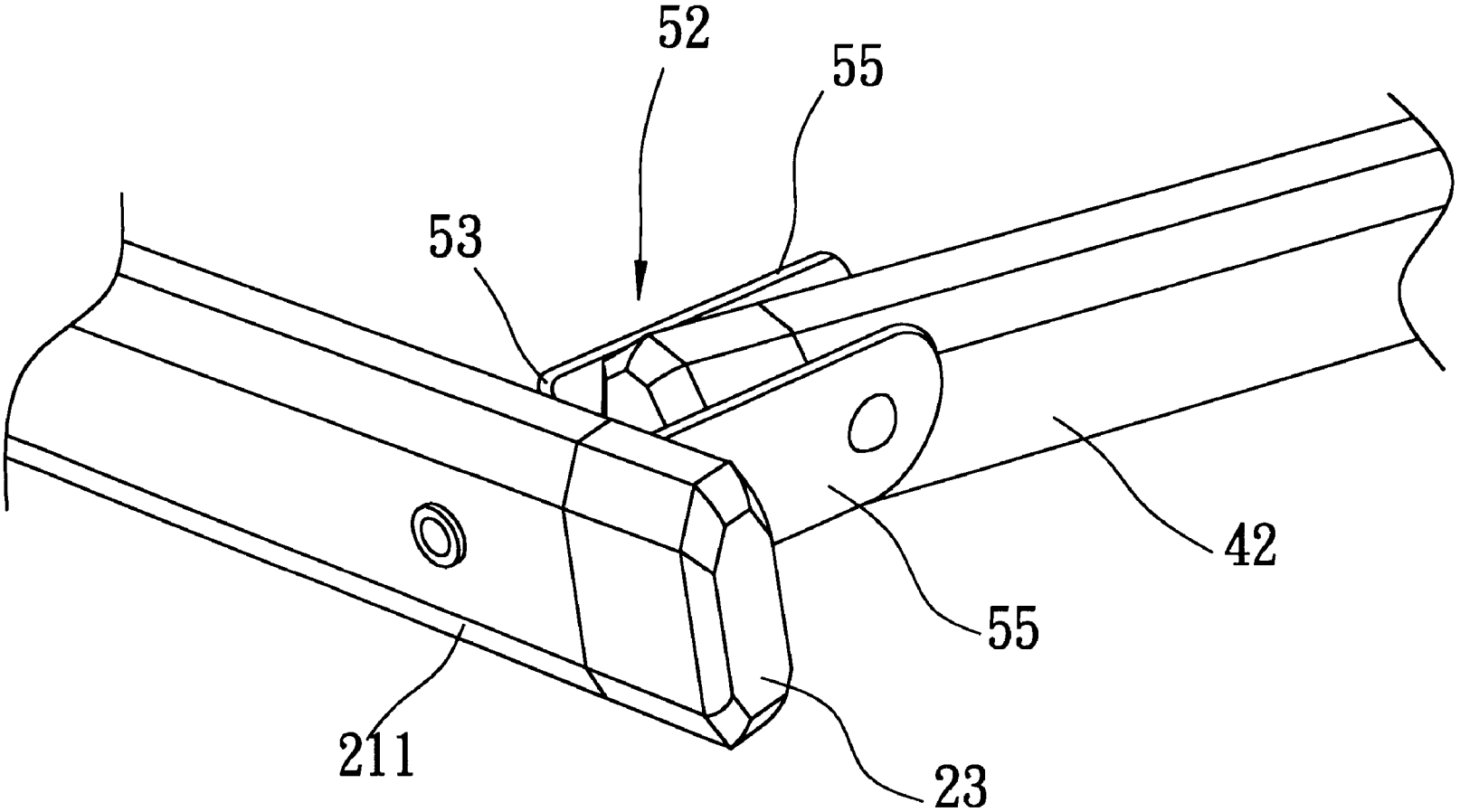
FIG. 10 is a fragmentary perspective view showing a U-shaped pivot bracket which interconnects an upper front leg part and a second side leg member according to the preferred embodiment.
Figure 11:
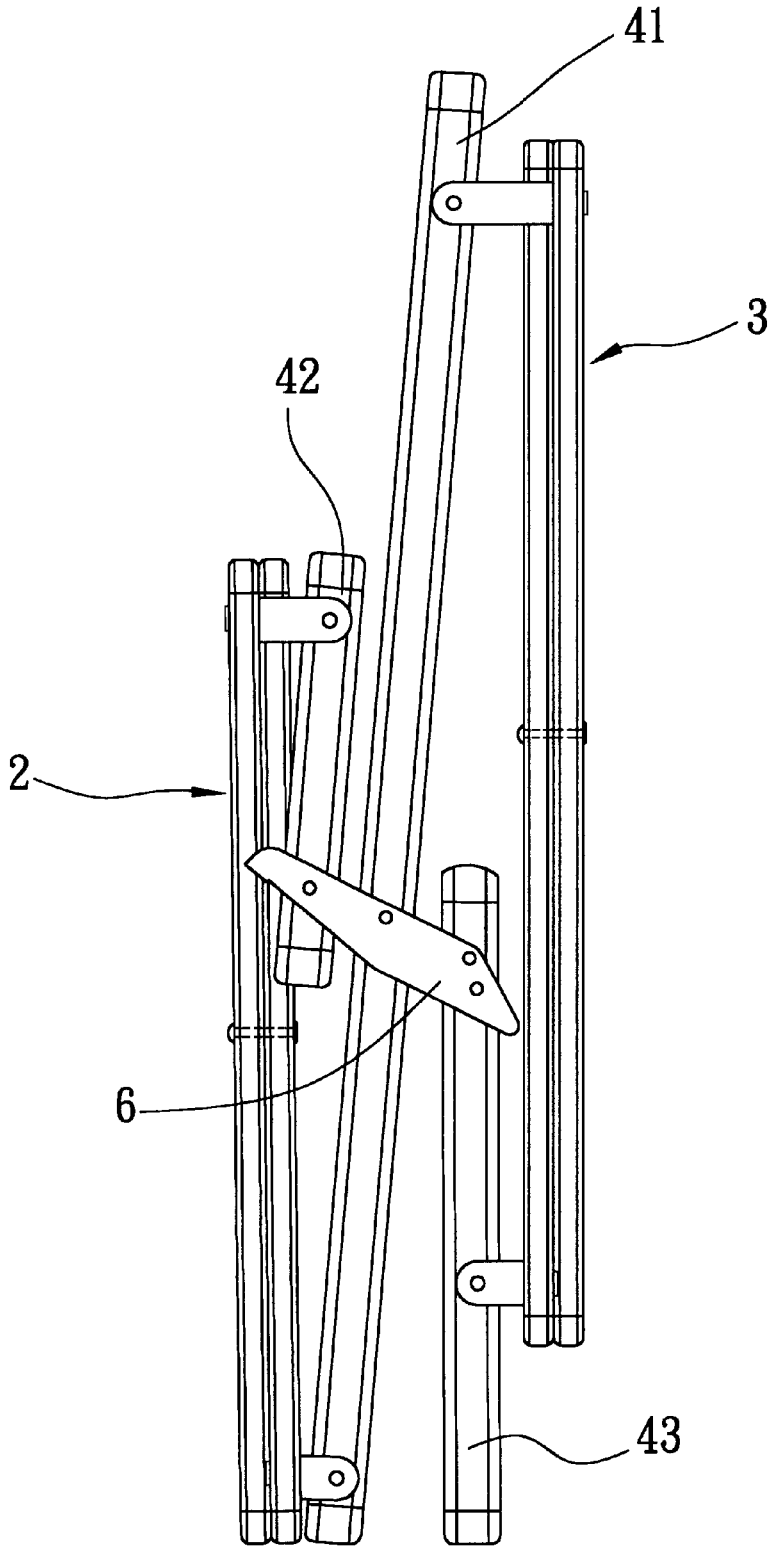
FIG. 11 is a side view showing the preferred embodiment in the folded state.

Referring to FIGS. 2, 5 and 10, each of the pivot brackets 51, 52 includes a rectangular base plate 53 mounted on the respective one of the upper and lower front leg parts 211, 212 and the upper and lower rear leg parts 311, 312, and a pair of parallel fin plates 54, 55 that extend from the base plate 53. Each of the fin plates 54, 55 has a length measured in a direction that is transverse to a longitudinal direction of the respective one of the front and rear leg members 21, 31. The length of the fin plates 54 of the pivot brackets 51 that are mounted on the lower front and rear leg parts 212, 312 is shorter than that of the fin plates 55 of the pivot brackets 52 that are mounted on the upper front and rear leg parts 211, 311, as best seen in FIG. 7. Such an arrangement can result in a more compact structure during folding of the preferred embodiment, as shown in FIG. 11.

Referring once again to FIGS. 2 and 3, when the preferred embodiment is in an unfolded state, the grooved end wall 432 of the end cap 431 engages removably the corresponding first side leg member 41 such that the latter is partly surrounded by the former, whereas the second side leg member 42 is limited by the bridging plate 62 from moving relative to the coupling member 6.

Figure 6:
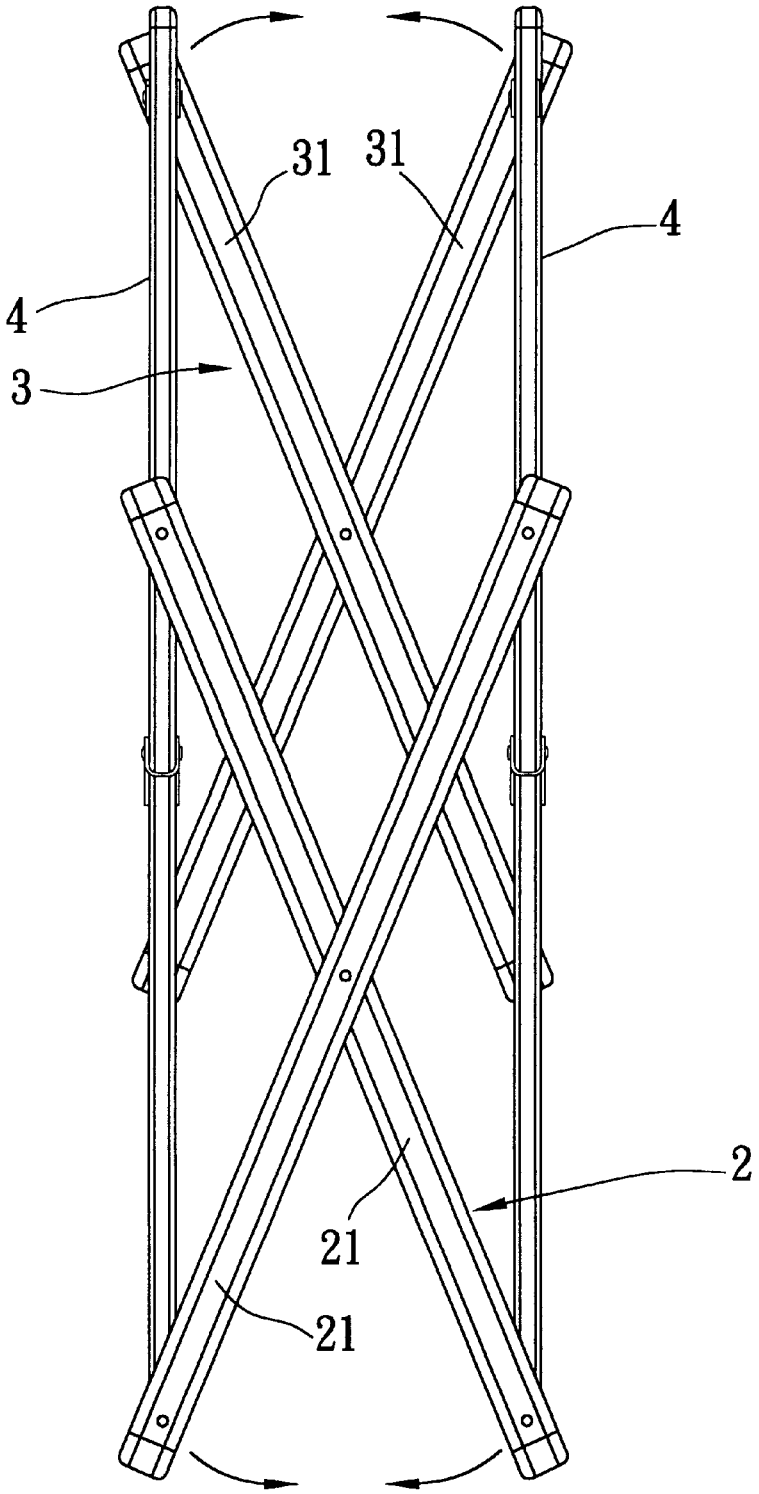
FIG. 6 is a front elevation view illustrating folding of the preferred embodiment.
Figure 8:
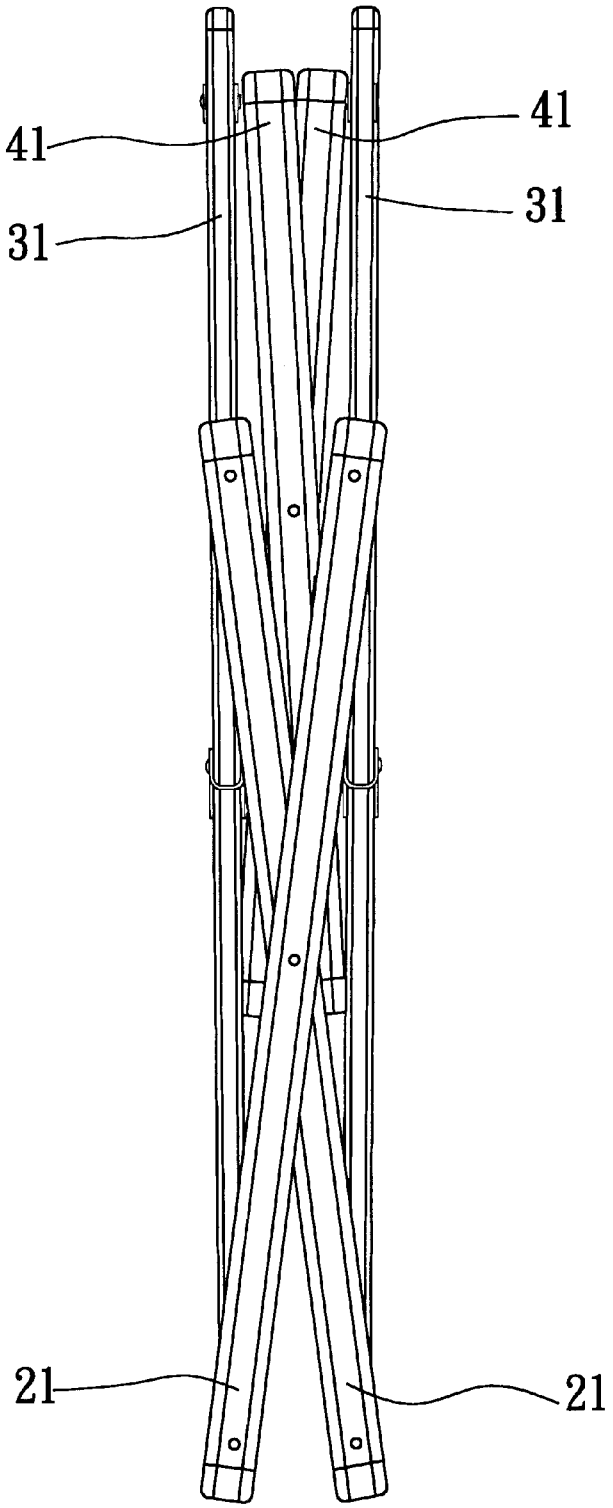
FIG. 8 is a front elevation illustrating the preferred embodiment in a folded state.

During folding of the preferred embodiment, as shown in FIGS. 6 and 7, the front leg members 21 of the front leg unit 2 are brought towards each other, and the rear leg members 31 of the rear leg unit 3 are simultaneously brought towards each other. Due to the arrangement of the pivot brackets 51, 52, the first, second, and third side leg members 41, 42, 43 of each of the first and second side frame units 4 are brought towards each other with the movement of the front and rear leg units 2, 3. FIGS. 8 and 11 show the preferred embodiment in the folded state.

By virtue of the above-described construction, the present invention has the following advantages:

1. Since each of the side frame units 4 is composed of three side leg members 41, 42, 43 instead of two as in the prior art, the position of the front leg unit 2 relative to the rear leg unit 3 can be desirably configured to obtain an ergonomic chair frame.

2. Due to the arrangement of the pivot brackets 51, 52, and the coupling members 6, the chair frame of this invention can be folded both longitudinally and transversely to result in a very compact structure to facilitate storage and transport.

It is noted that the advantages of this invention can be achieved with the addition of the coupling members 6, which means that the manufacturing costs will not be increased considerably as compared with the prior art.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable chair frame, comprising:

a cross-shaped front leg unit including a pair of front leg members, each of which has an upper front leg part, a lower front leg part, and an intermediate front leg part between said upper and lower front leg parts, said intermediate front leg parts of said front leg members being connected pivotally to each other;

a cross-shaped rear leg unit including a pair of rear leg members, each of which has an upper rear leg part, a lower rear leg part, and an intermediate rear leg part between said upper and lower rear leg parts, said intermediate rear leg parts of said rear leg members being connected pivotally to each other;

a first side frame unit connected pivotally to said upper front leg part of one of said front leg members, said lower front leg part of the other one of said front leg members, said upper rear leg part of one of said rear leg members, and said lower rear leg part of the other one of said rear leg members; and a second side frame unit connected pivotally to said upper front leg part of the other one of said front leg members, said lower front leg part of said one of said front leg members, said upper rear leg part of the other one of said rear leg members, and said lower rear leg part of said one of said rear leg members;

each of said first and second side frame units including a first side leg member having an upper first leg portion, a lower first leg portion, and an intermediate leg portion between said upper and lower first leg portions, a second side leg member having an upper second leg portion and a lower second leg portion, a third side leg member having an upper third leg portion and a lower third leg portion, and an elongate coupling member having a first end section connected to said lower second leg portion of said second side leg member, a second end section connected to said upper third leg portion of said third side leg member, and an intermediate section between said first and second end sections and connected pivotally to said intermediate leg portion of said first side leg member, one of said second and third side leg members being connected pivotally to said coupling member to permit movement of said second and third side leg members away from said first side leg member to an unfolded position, said coupling member being provided with a first limit unit to arrest movement of said second side leg member relative to said first side leg member in the unfolded position, and a second limit unit to arrest movement of said third side leg member relative to said first side leg member in the unfolded position.

2. The foldable chair frame of claim 1, wherein said coupling member includes a parallel pair of side plates having said first side leg member extending therebetween, said second side leg member being connected pivotally to said coupling member, said first limit unit including a bridging plate interconnecting said side plates at said first end section and abutting against said second side leg member to limit movement of said second side leg member relative to said coupling member when said second side leg member is in the unfolded position.

3. The foldable chair frame of claim 1, wherein said second limit unit includes a pair of mounting pins for fixing said third side leg member to said second end section of said coupling member.

4. The foldable chair frame of claim 1, wherein said upper third leg portion of said third side leg member is provided with an end cap, said end cap having a grooved end wall to engage removably said first side leg member when said third side leg member is in the unfolded position.

5. The foldable chair frame of claim 1, wherein:

said upper first leg portion is connected pivotally to one of said upper rear leg parts of said rear leg unit;

said lower first leg portion is connected pivotally to one of said lower front leg parts of said front leg unit;

said upper second leg portion is connected pivotally to one of said upper front leg parts of said front leg unit; and said lower third leg portion is connected pivotally to one of said lower rear leg parts of said rear leg unit.

6. The foldable chair frame of claim 5, wherein each of said upper and lower front leg parts and said upper and lower rear leg parts has a U-shaped pivot bracket mounted thereon for connecting pivotally with one of said first, second and third side leg members.

7. The foldable chair frame of claim 6, wherein said pivot bracket includes a base plate mounted on the respective one of said leg parts, and a pair of parallel fin plates that extend from said base plate.

8. The foldable chair frame of claim 7, wherein each of said fin plates has a length measured in a direction that is transverse to a longitudinal direction of the respective one of said front and rear leg members, the length of said fin plates of said pivot brackets that are mounted on said lower front and rear leg parts being shorter than that of said fin plates of said pivot brackets that are mounted on said upper front and rear leg parts.

* * * * *